US011959708B2

(12) United States Patent
Byman et al.

(10) Patent No.: US 11,959,708 B2
(45) Date of Patent: Apr. 16, 2024

(54) PLATE HEAT EXCHANGER FOR HEATING OR COOLING BULK SOLIDS

(71) Applicants: SOLEX THERMAL SCIENCE INC., Calgary (CA); NATIONAL TECHNOLOGY AND ENGINEERING SOLUTIONS OF SANDIA, Albuquerque, NM (US); VACUUM PROCESS ENGINEERING, INC., Sacramento, CA (US)

(72) Inventors: Ashley D. Byman, Heritage Pointe (CA); Robert McGillivray, Calgary (CA); Brandon Emmanuel St Germain, Sherwood Park (CA); Layne Charles, Calgary (CA); Kevin James Albrecht, Albuquerque, NM (US); Dereje Shiferaw Amogne, Rocklin, CA (US); Matthew David Carlson, Albuquerque, NM (US); Clifford Kuofei Ho, Albuquerque, NM (US); Carl P. Schalansky, Sacramento, CA (US); Aaron Edward Wildberger, El Dorado Hills, CA (US)

(73) Assignees: Solex Thermal Science Inc., Calgary (CA); National Technology and Engineering Solutions of Sandia, Albuquerque, NM (US); Vacuum Process Engineering, Inc., Sacramento, CA (US)

( * ) Notice: Subject to any disclaimer, the term of this patent is extended or adjusted under 35 U.S.C. 154(b) by 136 days.

(21) Appl. No.: 16/772,764

(22) PCT Filed: Nov. 6, 2018

(86) PCT No.: PCT/CA2018/051404

§ 371 (c)(1),
(2) Date: Jun. 12, 2020

(87) PCT Pub. No.: WO2019/113680

PCT Pub. Date: Jun. 20, 2019

(65) Prior Publication Data

US 2021/0164735 A1 Jun. 3, 2021

Related U.S. Application Data

(60) Provisional application No. 62/598,586, filed on Dec. 14, 2017.

(51) Int. Cl.
*F28F 3/08* (2006.01)
*F28D 9/00* (2006.01)
(Continued)

(52) U.S. Cl.
CPC ..... *F28F 3/083* (2013.01); *F28D 9/0043* (2013.01); *F28D 9/005* (2013.01); *F28D 9/0062* (2013.01);
(Continued)

(58) Field of Classification Search
CPC .... F28F 3/083; F28F 3/086; F28F 3/10; F28F 3/08; F28F 3/12; F28F 7/1653;
(Continued)

(56) References Cited

U.S. PATENT DOCUMENTS 1,528,696 A * 3/1925 Wilfrid ..... F26B 17/16 34/68
4,347,896 A * 9/1982 Rosman ..... F28D 9/0037 165/DIG. 392
(Continued)

FOREIGN PATENT DOCUMENTS

CN 104350350 A 2/2015
CN 105074982 A 11/2015
(Continued)

OTHER PUBLICATIONS

Chinese Patent Application No. 201880086325.2, Office Action dated Jul. 1, 2021, including English translation; 27 pages.
(Continued)

*Primary Examiner* — Jianying C Atkisson
*Assistant Examiner* — For K Ling
(74) *Attorney, Agent, or Firm* — Schwabe, Williamson & Wyatt, PC

(57) ABSTRACT

A heat exchanger includes an inlet for receiving bulk solids, a plurality of heat transfer plate assemblies, a plurality of spacers disposed between adjacent heat transfer plate assemblies, and supports for supporting the heat transfer plate assemblies. The heat transfer plate assemblies include a first plate having a first pair of holes extending therethrough, the first plate having channels extending along a surface thereof, for the flow of fluid through the channels, and a second plate bonded to the first plate to enclose the channels, the second plate including a second pair of holes generally aligned with
(Continued)

the first pair of holes to form through holes to facilitate flow of the fluid through the through holes and the channels.

28 Claims, 7 Drawing Sheets

(51) Int. Cl.
*F28D 21/00* (2006.01)
*F28F 3/10* (2006.01)

(52) U.S. Cl.
CPC ..... *F28D 2021/0045* (2013.01); *F28F 3/10* (2013.01); *F28F 2275/061* (2013.01)

(58) Field of Classification Search
CPC ..... F28F 7/163; F28D 9/0031; F28D 9/0043; F28D 9/0037; F28D 9/0075; F28D 1/0333; F28D 1/0325; F28D 1/0316; F28D 1/0308; F28D 2021/0045; F26B 17/16
See application file for complete search history.

(56) References Cited

U.S. PATENT DOCUMENTS

| | | | | | |
|---|---|---|---|---|---|
| 4,420,739 | A * | 12/1983 | Herren | F28D 9/0043 | 338/53 |
| 5,167,274 | A | 12/1992 | Mueller | | |
| 5,249,359 | A * | 10/1993 | Schubert | B01J 19/0093 | 29/17.2 |
| 5,664,426 | A * | 9/1997 | Lu | F28F 27/02 | 62/93 |
| 6,328,099 | B1 * | 12/2001 | Hilt | C05G 5/12 | 165/166 |
| RE37,653 | E * | 4/2002 | Anderson | F26B 17/1416 | 34/169 |
| 7,200,007 | B2 * | 4/2007 | Yasui | H02M 7/003 | 338/53 |
| 7,231,960 | B2 * | 6/2007 | Sakai | H01L 23/473 | 165/83 |
| 7,940,526 | B2 * | 5/2011 | Schulz-Harder | H01L 25/072 | 165/185 |
| 2008/0116246 | A1 * | 5/2008 | Rigal | F28F 3/12 | 228/193 |
| 2009/0211740 | A1 * | 8/2009 | Kesseli | F28D 9/0075 | 165/166 |
| 2009/0266507 | A1 | 10/2009 | Turnbull et al. | | |
| 2013/0020063 | A1 * | 1/2013 | Fetvedt | F28F 3/048 | 165/168 |
| 2013/0292093 | A1 | 11/2013 | Huang et al. | | |
| 2014/0246184 | A1 | 9/2014 | Byman | | |
| 2015/0168075 | A1 | 6/2015 | Bertilsson | | |
| 2015/0349353 | A1 | 12/2015 | Hood | | |
| 2016/0076813 | A1 | 3/2016 | Skold | | |
| 2016/0153317 | A1 * | 6/2016 | Geskes | F01K 23/10 | 62/515 |
| 2016/0293352 | A1 * | 10/2016 | Zacharias | B21D 39/035 | |
| 2017/0023311 | A1 * | 1/2017 | Urbanski | F28D 9/0037 | |
| 2017/0030660 | A1 * | 2/2017 | Cachon | F28F 3/048 | |

FOREIGN PATENT DOCUMENTS

| | | | | |
|---|---|---|---|---|
| EP | 0018823 | B1 | 7/1984 | |
| GB | 1277872 | A * | 6/1972 | |
| JP | 2002250595 | A * | 9/2002 | F28D 9/0043 |
| WO | 1990/013394 | A1 | 11/1990 | |
| WO | 9013394 | A1 | 11/1990 | |
| WO | WO-9013394 | A1 * | 11/1990 | B23K 1/0012 |
| WO | WO-2014064334 | A1 * | 5/2014 | F28D 1/0325 |

OTHER PUBLICATIONS

European Patent Application No. 18889479.4, Extended European Search Report dated Nov. 15, 2021; 10 pages.

* cited by examiner

PLATE HEAT EXCHANGER FOR HEATING OR COOLING BULK SOLIDS

CROSS REFERENCE TO RELATED APPLICATIONS

The present application is a national phase entry under 35 U.S.C. § 371 of International Application No. PCT/CA2018/051404 filed Nov. 6, 2018, entitled "PLATE HEAT EXCHANGER FOR HEATING OR COOLING BULK SOLIDS," which designated, among the various States, the United States of America, and which claims priority to U.S. Provisional Patent Application No. 62/598,586 filed Dec. 14, 2017, which is hereby incorporated by reference.

ACKNOWLEDGEMENT OF GOVERNMENT SUPPORT

The invention was made with government support under Contract No. DE-NA0003525 between the United States Department of Energy and National Technology & Engineering Solutions of Sandia, LLC, for the operation of the Sandia National Laboratories. The government has certain rights in the invention.

FIELD OF THE INVENTION

The present disclosure relates to heat exchangers for heating or cooling bulk solids.

BACKGROUND

Indirect-heat thermal processors for heating or cooling bulk solids may utilize hot gases for heating or drying bulk solids or cool gases for cooling the bulk solids as the bulk solids flow through the heater, cooler, or dyer. The use of such gases is inefficient as large volumes of air or other gases are utilized and waste heat in the exhaust gas is difficult to recover.

Heat transfer plates or tubes provide improved efficiency in heat exchangers by indirectly heating or cooling bulk solids that flow, under the force of gravity, through a heat exchanger. The heat transfer plates or tubes include a heat exchange fluid flowing through the plates or tubes and the bulk solids are heated or cooled as they flow through spaces between adjacent heat transfer plates or tubes.

Applications for such heat exchangers vary widely. The heat transfer systems including plates or tubes referred to above are generally useful in relatively low pressure and low temperature heat exchange applications. Such heat exchangers are unsuitable in other applications in which high temperature fluids or high pressure fluids are utilized due to limitations of the heat transfer plates and tubes. For example, applications for energy recovery and storage may involve hot bulk solids and high pressure heat exchange fluid from which heat recovery is desirable.

Improvements to heat exchangers are desirable.

SUMMARY

According to one aspect of an embodiment, a heat exchanger includes an inlet for receiving bulk solids, a plurality of heat transfer plate assemblies, a plurality of spacers disposed between adjacent heat transfer plate assemblies, and supports for supporting the plurality of heat transfer plate assemblies. The heat transfer plate assemblies include a first sheet having a first pair of holes extending through the first sheet and channels extending along a surface thereof, for the flow of fluid from a first of the first pair of holes, through the channels, to a second of the first pair of holes, and a second sheet bonded to the first sheet to enclose the channels between the first sheet and the second sheet, the second sheet including a second pair of holes generally aligned with the first pair of holes of the first sheet to form first through holes and second through holes to facilitate flow of the fluid through the first through holes, through the channels, and through the second through holes. The spacers are disposed between adjacent heat transfer plate assemblies to space the adjacent heat transfer plate assemblies apart to facilitate the flow of the bulk solids from the inlet, between the adjacent heat transfer plate assemblies.

According to another aspect of an embodiment, a heat exchanger is provided. The heat exchanger includes an inlet for receiving bulk solids, a plurality of heat transfer plate assemblies arranged in banks with the heat transfer plate assemblies of each bank arranged generally parallel to each other, a plurality of spacers disposed between adjacent heat transfer plate assemblies within each bank, and supports for supporting the banks of heat transfer plate assemblies. Each heat transfer plate assembly includes a first sheet having channels extending along a surface thereof, and a second sheet bonded to the first sheet to enclose the channels between the first sheet and the second sheet. The first sheet and the second sheet together have first through holes near a first side edge of the heat transfer plate assemblies, in fluid communication with first ends of the channels, and second through holes near a second side edge of the heat transfer plate assemblies, in fluid communication with second ends of the channels to facilitate flow of the fluid through the first through holes, through the channels, and through the second through holes. The spacers are disposed between adjacent heat transfer plate assemblies within each bank, to space the adjacent heat transfer plate assemblies apart to facilitate the flow of the bulk solids from the inlet, between the adjacent heat transfer plate assemblies, the spacers including holes extending therethrough. The heat transfer plate assemblies and spacers in each bank are coupled together such that the first through holes of the heat transfer plate assemblies and holes of the spacers form a first conduit, and the second through holes and spacers form a second conduit in each bank.

According to yet another embodiment, there is provided a bank of heat transfer plate assemblies for use in a heat exchanger. The bank of heat transfer plate assemblies includes a plurality of heat transfer plate assemblies arranged generally parallel to each other. The heat transfer plate assemblies include a first sheet having channels extending along a surface thereof, and a second sheet bonded to the first sheet to enclose the channels between the first sheet and the second sheet, the first sheet and the second sheet together having first through holes near a first side edge of the heat transfer plate assemblies and in fluid communication with first ends of the channels, and second through holes near a second side edge of the heat transfer plate assemblies and in fluid communication with second ends of the channels to facilitate flow of the fluid through the first through holes, through the channels, and through the second through holes. The bank also includes a plurality of spacers disposed between adjacent heat transfer plate assemblies to space the adjacent heat transfer plate assemblies apart to facilitate the flow of the bulk solids between the adjacent heat transfer plate assemblies, the spacers including holes extending therethrough. The heat transfer plate assemblies and spacers in the bank are coupled together such that the first through holes of the heat transfer plate assemblies and holes of the spacers form a first conduit, and the second through holes and spacers form a second conduit.

BRIEF DESCRIPTION OF THE DRAWINGS

Embodiments of the present invention will be described, by way of example, with reference to the drawings and to the following description, in which.

DETAILED DESCRIPTION OF THE PREFERRED EMBODIMENTS

Figure 1:
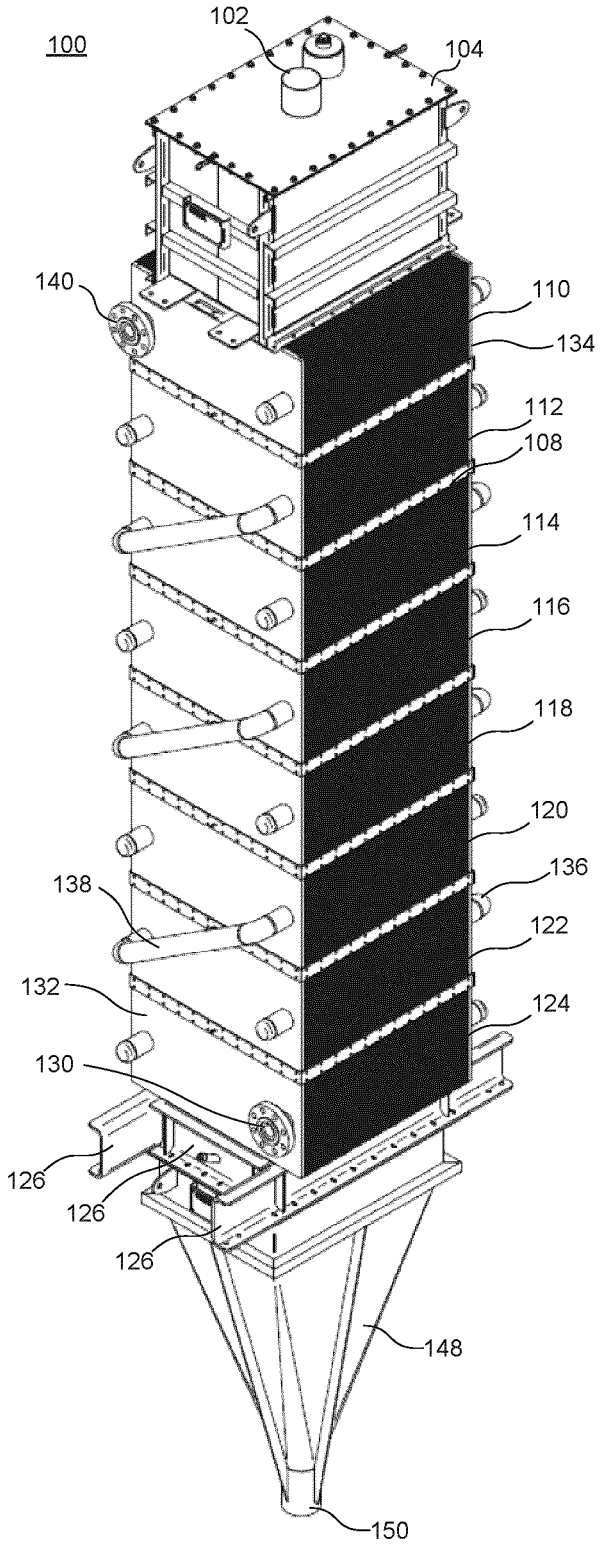
FIG. 1 is a perspective view of a heat exchanger in accordance with an embodiment.

For simplicity and clarity of illustration, reference numerals may be repeated among the figures to indicate corresponding or analogous elements. Numerous details are set forth to provide an understanding of the embodiments described herein. The embodiments may be practiced without these details. In other instances, well-known methods, procedures, and components have not been described in detail to avoid obscuring the embodiments described. The description is not to be considered as limited to the scope of the embodiments described herein.

The disclosure generally relates to heat exchangers for heating or cooling bulk solids, and the corresponding cooling or heating of the heat transfer fluid. The heat exchanger includes an inlet for receiving bulk solids, a plurality of heat transfer plate assemblies, a plurality of spacers disposed between adjacent heat transfer plate assemblies, and supports for supporting the plurality of heat transfer plate assemblies. The heat transfer plate assemblies include a first sheet having a first pair of holes extending through the first sheet and channels extending along a surface thereof, for the flow of fluid from a first of the first pair of holes, through the channels, to a second of the first pair of holes, and a second sheet bonded to the first sheet to enclose the channels between the first sheet and the second sheet, the second sheet including a second pair of holes generally aligned with the first pair of holes of the first sheet to form first through holes and second through holes to facilitate flow of the fluid through the first through holes, through the channels, and through the second through holes. The spacers are disposed between adjacent heat transfer plate assemblies to space the adjacent heat transfer plate assemblies apart to facilitate the flow of the bulk solids from the inlet, between the adjacent heat transfer plate assemblies.

Figure 2:
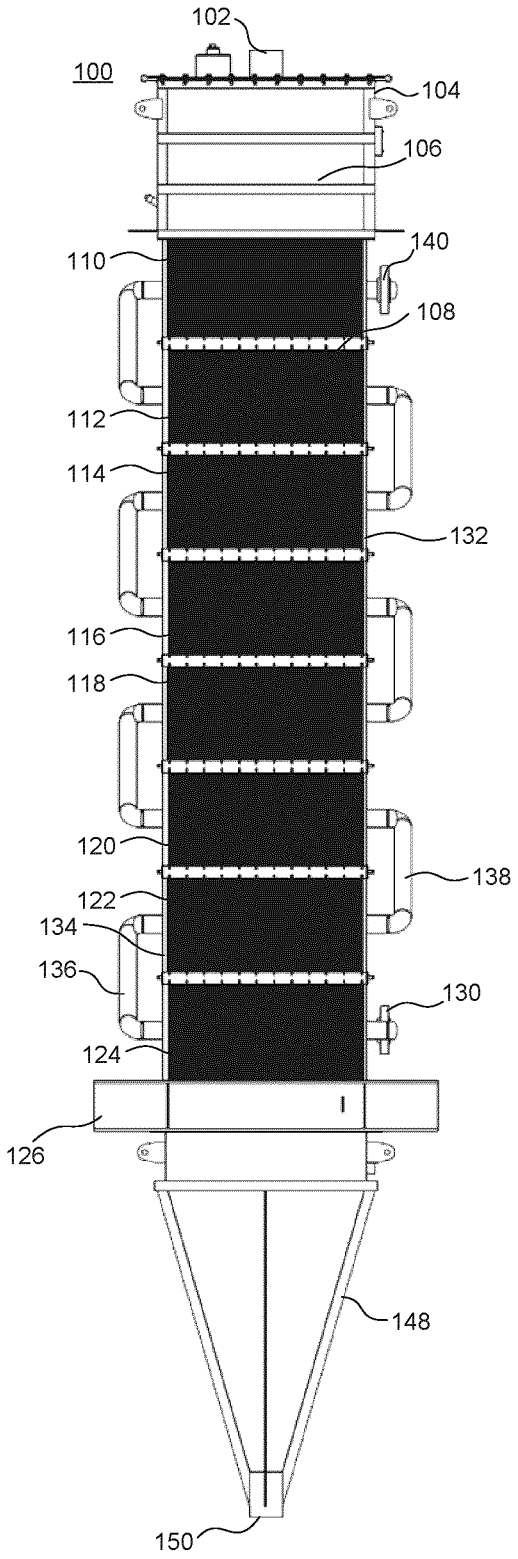
FIG. 2 is a side view of the heat exchanger of FIG. 1.
Figure 3:
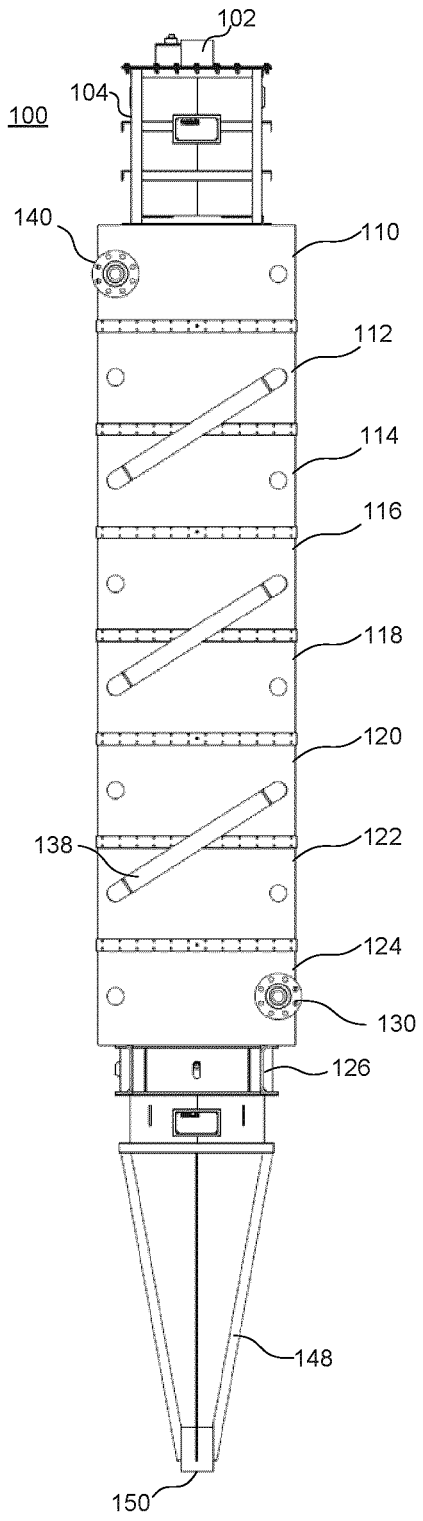
FIG. 3 is a front view of the heat exchanger of FIG. 1.

FIG. 1 through FIG. 3 show views of an embodiment of a heat exchanger 100, which in this example is utilized for cooling bulk solids. The heat exchanger 100 includes an inlet 102 in a top of an inlet housing 104 at the top of the heat exchanger 100, for introducing bulk solids into the heat exchanger 100. The bulk solids may be any suitable flowable solids such as ceramic beads, sand, sintered bauxite, or any other suitable flowable solid. The inlet housing 104 provides an inlet hopper 106. The inlet hopper 106 facilitates distribution of bulk solids that flow from the inlet 102, as a result of the force of gravity by disbursing the bulk solids over substantially the whole cross-section of the heat exchanger 100.

The heat transfer plate assemblies are arranged in rows. In the present example, the heat transfer plate assemblies 108 are arranged in eight rows, referred to as banks 110, 112, 114, 116, 118, 120, 122, 124, each including a plurality of the heat transfer plate assemblies 108. The heat transfer plate assemblies 108 in the first bank 110 are generally parallel to each other and are spaced apart to leave passageways between adjacent heat transfer plate assemblies 108 for the flow of bulk solids. Similarly, the heat transfer plate assemblies 108 of the subsequent banks 112, 114, 116, 118, 120, 122, 124 are generally parallel to each other and are spaced apart to leave passageways between the adjacent heat transfer plate assemblies 108 of each of the banks for the flow of bulk solids.

The banks 110, 112, 114, 116, 118, 120, 122, 124 are arranged generally vertically with the first bank 110 at the top, followed by the second bank 112, the third bank 114, the fourth bank 116, the fifth bank 118, the sixth bank 120, the seventh bank 122, and the eight, or bottom bank 124.

The banks 110, 112, 114, 116, 118, 120, 122, 124 are supported on support rails 126 that extend under the bottom bank 124 of heat transfer plate assemblies 108. Further support rails may also be utilized, for example, between banks. Alternatively or in addition, supports may extend above one or more banks for supporting the banks from above. Although the heat exchanger 100 of FIG. 1 includes eight banks 110, 112, 114, 116, 118, 120, 122, 124 of heat transfer plate assemblies 108, other suitable numbers heat transfer plate assemblies 108 may be utilized and any suitable number of heat transfer plate assemblies 108 may be utilized in each bank.

The bulk solids flow through the spaces between the heat transfer plate assemblies 108, which spaces provide the passageways through the banks 110, 112, 114, 116, 118, 120, 122, 124 of the heat transfer plate assemblies 108. The bulk solids that contact the heat transfer plate assemblies 108 are deflected into the passageways.

The bulk solids then flow from the passageways and are discharged, for example, through a discharge hopper 148 in which the bulk solids are discharged under a "choked" flow to control the rate of flow through the heat exchanger 100, and out of the heat exchanger 100. In the example shown in FIG. 1, the discharge hopper 148 is a cone hopper. Other discharge devices and geometries may be successfully implemented, however.

Figure 4:
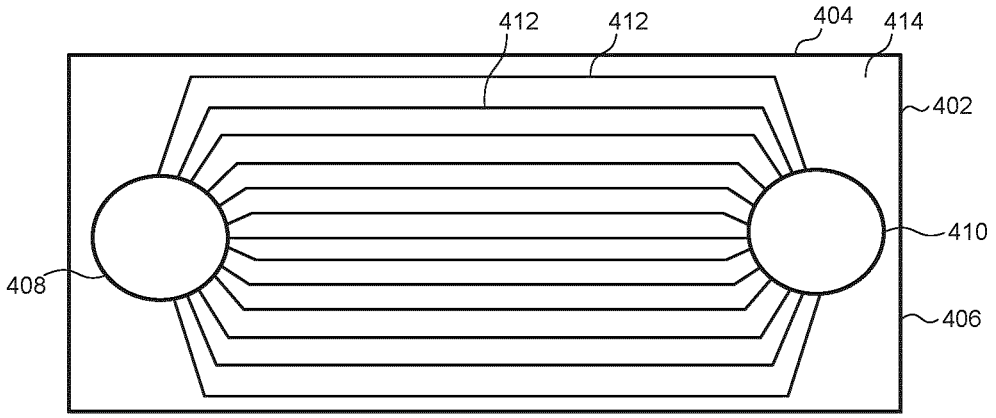
FIG. 4 is a front view of a sheet of a heat transfer plate assembly in accordance with an embodiment.

Reference is now made to FIG. 4, which shows a front view of a portion of a heat transfer plate assembly 108. A heat transfer plate assembly 108 of the heat exchanger 100 includes at least two thin sheets 402 of, for example, an alloy such as Inconel, a stainless steel, or any other suitable alloy. In the present example, the heat transfer plate assembly 108 includes four thin sheets of about 0.060 inches in thickness (1.524 mm). The sheets in the present embodiment are generally rectangular, including long edges 404 and shorter side edges 406. The sheets 402 may be any suitable shape and size, however. In the present example, the long edges 404 are about 26 inches (66.0 cm) and the short edges are about 8 inches (20.3 cm) long.

Each of the sheets include a pair of holes 408, 410 extending through the thickness of the sheets, with a first one of the holes 408 near a first side edge 406 and the second hole 410 near the opposing side edge 406.

Three of the sheets 402 include channels 412 therein. The channels 412 may be selectively etched in each sheet, for example, by photoetching to create channels 412 in a face of the sheet 402, with the channels 412 extending continuously from the first hole 408 to the second hole 410. The channels 412 do not extend through the entire thickness of the sheet 402. The channels 412 are spaced from each other and are distributed between the long edges 404 of the sheet. In the present example, 13 channels 412 are shown extending from the first hole 408 to the second hole 410. Any suitable number of channels 412 may be successfully employed, however. As indicated, the channels 412 may be formed by selectively photoetching the sheets 402. The resulting channels 412 are generally half-circular in cross section as a result of the selective etching process.

The four sheets 402 that together make up the heat transfer plate assembly 108, are stacked together such that each face 414 that includes the channels 412, abuts an adjacent sheet 402 to enclose the channels between sheets 402. The stack of sheets 402 is heated in a vacuum furnace with mechanical pressure applied, to cause diffusion of the sheets 402 into each other. The diffusion results in a single heat transfer plate assembly of about 0.240 inches thickness (6.096 mm) that includes the stacked sheets 402 that are diffusion bonded together.

In the example shown in FIG. 4, the channels 412 extend across the sheet 402 from the first hole 408 to the second hole 410. Each channel 412 extends across the sheet 402 once. Alternatively, each channel may extend across the sheet more than once, such that each channel extends from the first hole, and across the sheet 402 in multiple passes before joining the second hole. The second hole may optionally be on a same side of the sheets such that both holes are near the same side edge 406 and each channel extends across the sheet 402 in an even number of passes from the first hole to the second hole. Optionally, the channels may include portions that extend generally vertically or the channels, and thus the heat transfer plate assemblies may be configured such that the channels flow substantially vertically.

Diffusion bonding may be carried out on several stacks of sheets 402 to create several diffusion bonded plates at a time. The diffusion bonded plates may be maintained separate by including a sheet or plate of dissimilar material that does not diffusion bond with the material of the sheets 402, between each stack of the sheets 402 that form a single heat transfer plate assembly 108.

In the above description, each sheet 402 is described as including the first hole 408 and the second hole 410. Alternatively, the sheets may be selectively etched as described and diffusion bonded prior to creating the holes through the resulting heat transfer plate assembly 108.

Figure 5:
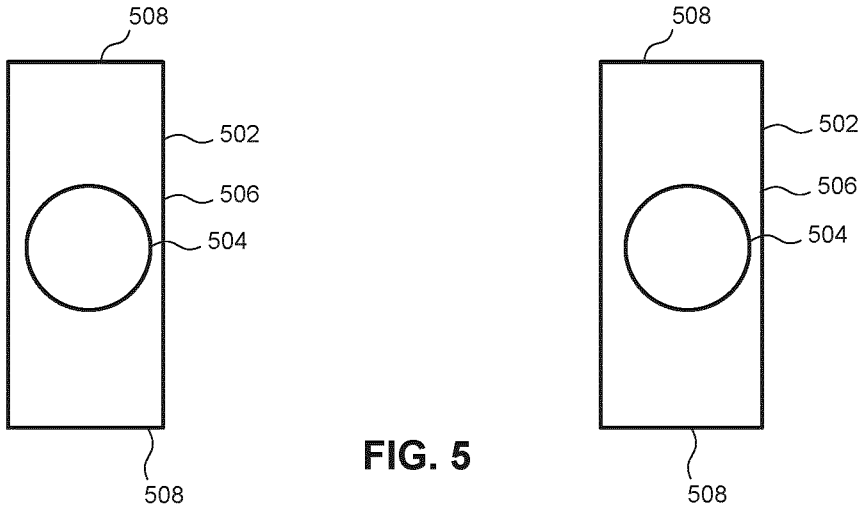
FIG. 5 is a view of spacers utilized between heat transfer plate assemblies in a bank in accordance with an embodiment.

Referring to FIG. 5, spacers 502 are shown. The spacers 502 are utilized to space the heat transfer plate assemblies 108 apart in the heat exchanger 100, to facilitate the flow of bulk solids between the heat transfer plate assemblies 108. The spacers 502 are generally rectangular in the present example, and each spacer 502 includes a hole 504 extending therethrough. For the purpose of the present example, a side edge 506 of the spacers 502 is about the length of a side edge 406 of the sheets 402. The top and bottom edges 508 of the spacers 502, however, have a length that is significantly shorter than the long edges 404 of the sheets 402. The holes 504 extending through the spacers are similar in size to the holes in the sheets 402. The spacers 502 may be any suitable thickness to provide suitable spacing between the heat transfer plate assemblies 108 for the flow of bulk solids between the heat transfer plate assemblies 108. For example, the spacers 502 may be about 0.25 inches (6.35 mm) thick.

Figure 6:
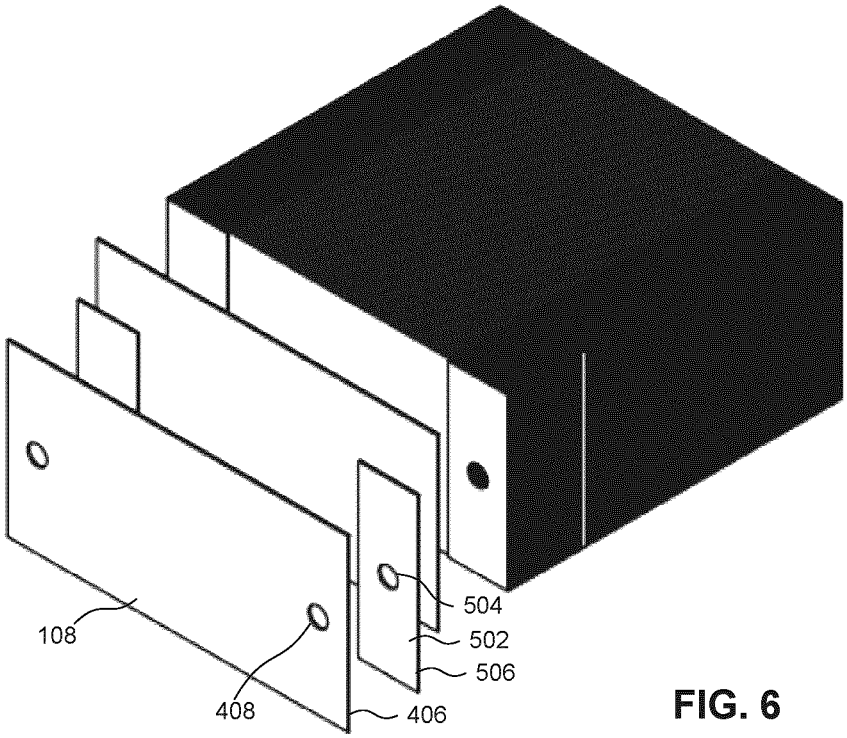
FIG. 6 is an exploded perspective view of a bank of heat transfer plate assemblies in accordance with an embodiment.

The heat transfer plate assemblies 108 are stacked with two spacers 502 disposed between each pair of adjacent heat transfer plate assemblies 108, as illustrated in FIG. 6. A side edge 506 of each of the two spacers 502 is adjacent a respective side edge 406 of each adjacent heat transfer plate assembly 108, thus providing a space, equal to the thickness of the spacers 502, between center portions of adjacent heat transfer plate assemblies 108. The heat transfer plate assemblies 108 and spacers 502 are joined together to provide a single bank of the heat transfer plate assemblies 108. The heat transfer plate assemblies 108 and the spacers 502 are aligned such that the holes 504 in the spacers 502 are aligned with the holes 408, 410 in the sheets.

Figure 7:
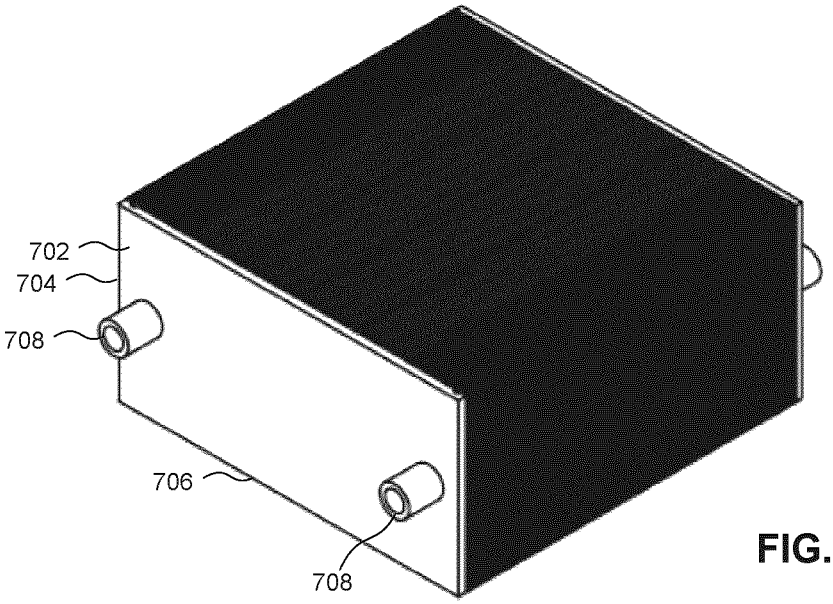
FIG. 7 is a perspective view of a bank of heat transfer plate assemblies in accordance with an embodiment.

As illustrated in FIG. 7, end plates 702 are also stacked with the heat transfer plate assemblies 108 such that each bank of heat transfer plate assemblies 108 includes two end plates 702, with one on each end of the stack. As with the sheets 402, each end plate 702 is generally rectangular in shape and includes side edges 704 that are about the length of the side edges 406 of the sheets 402 and long edges 706 that are about the length of the long edges 404 of the sheets. The end plates 702 may be made of any suitable material, such as Inconel or other suitable alloy. The end plates 702 are spaced from the adjacent heat transfer plate assembly 108 by spacers 502 and the end plates 702 are also joined in the stack, to the adjacent spacers 502. The end plates 702 include nozzles 708 that align with the holes 504 in the spacers 502 and with the holes 408, 410 in the sheets 402.

The end plates 702, spacers 502, and heat transfer plate assemblies 108 may all be joined together in the stack by diffusion bonding, by heating in a vacuum and under mechanical pressure. Thus, the end plates 702, the spacers 502, and the heat transfer plate assemblies 108 are joined together to form a single, unitary bank of heat transfer plate assemblies. Alternatively, the end plates 702, the heat transfer plate assemblies 108, and the spacers 502 may be bonded together by brazing or utilizing any other suitable bonding technique.

When joined to provide the unitary bank, the nozzles 708 of the end plates 702 are in fluid communication with the holes 504 in the spacers 502 and with the holes 408, 410 in the sheets 402 that form the heat transfer plate assemblies 108. Thus, the through holes of the heat transfer plate assemblies 108 in the first bank are all in fluid communication by the spacers to form a continuous conduit, utilized as a fluid manifold through the heat transfer plate assemblies 108 and spacers 502. Two continuous fluid manifolds are thus formed through the heat transfer plate assemblies 108 and the spacers 502 in the unitary bank.

The nozzles 708 may be utilized as a fluid inlet and a fluid outlet to facilitate the flow of fluid into one of the fluid manifolds formed in the heat transfer plate assemblies 108 and the spacers 502, through the channels in the sheets 402 that form the heat transfer plate assemblies 108, and out through the other fluid manifold formed in the heat transfer plate assemblies 108. Thus, two integral fluid manifolds are formed in the bank of heat transfer plate assemblies 108, for use as an inlet manifold and an outlet manifold.

A plurality of banks are joined together in a stack as illustrated in FIG. 1 through FIG. 3. As described, the present example includes eight banks 110, 112, 114, 116, 118, 120, 122, 124 arranged generally vertically with the first bank 110 at the top, followed by the second bank 112, the third bank 114, the fourth bank 116, the fifth bank 118, the sixth bank 120, the seventh bank 122, and the eight, or bottom bank 124.

Figure 8:
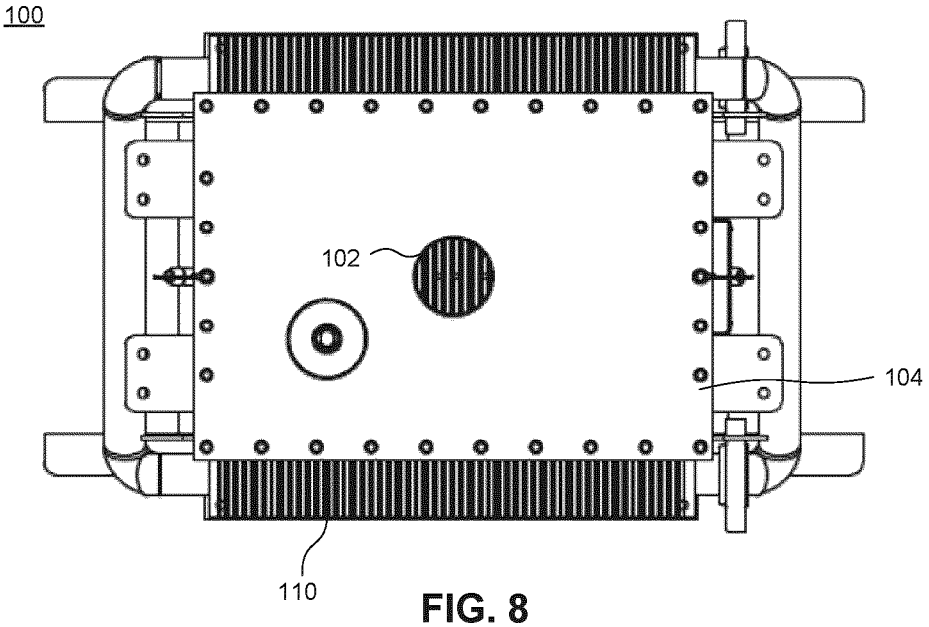
FIG. 8 is a top view of the heat exchanger of FIG. 1.

Referring now to FIG. 8, the inlet housing 104, which has a generally a rectangular cross-section, is coupled to the top bank 110 of the heat transfer plate assemblies 108. The inlet housing 104 provides the inlet hopper 106 for facilitating distribution of bulk solids that flow from the inlet 102, as a result of the force of gravity. Thus, the bulk solids are disbursed over substantially the whole cross-section of the heat exchanger 100.

Figure 9:
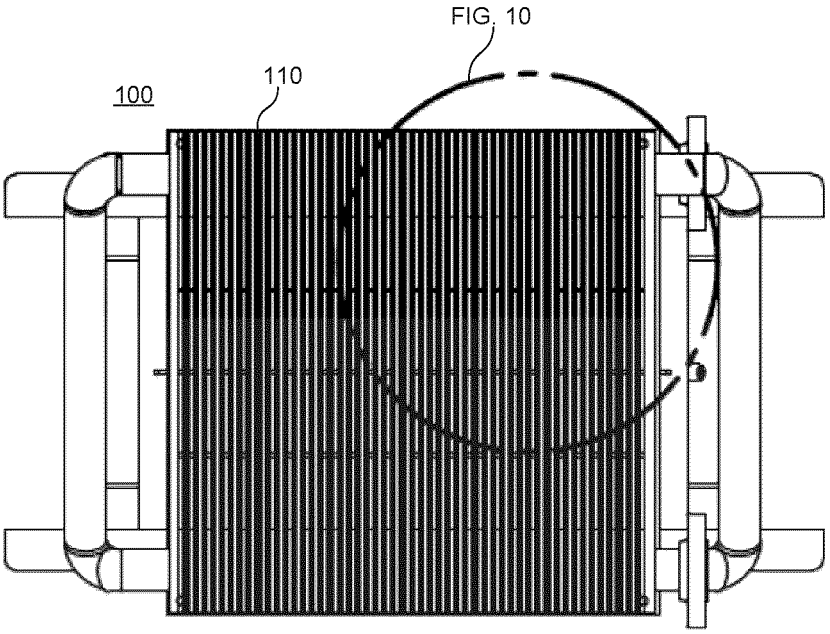
FIG. 9 is a top view of the heat exchanger of FIG. 1, with the inlet removed.
Figure 10:
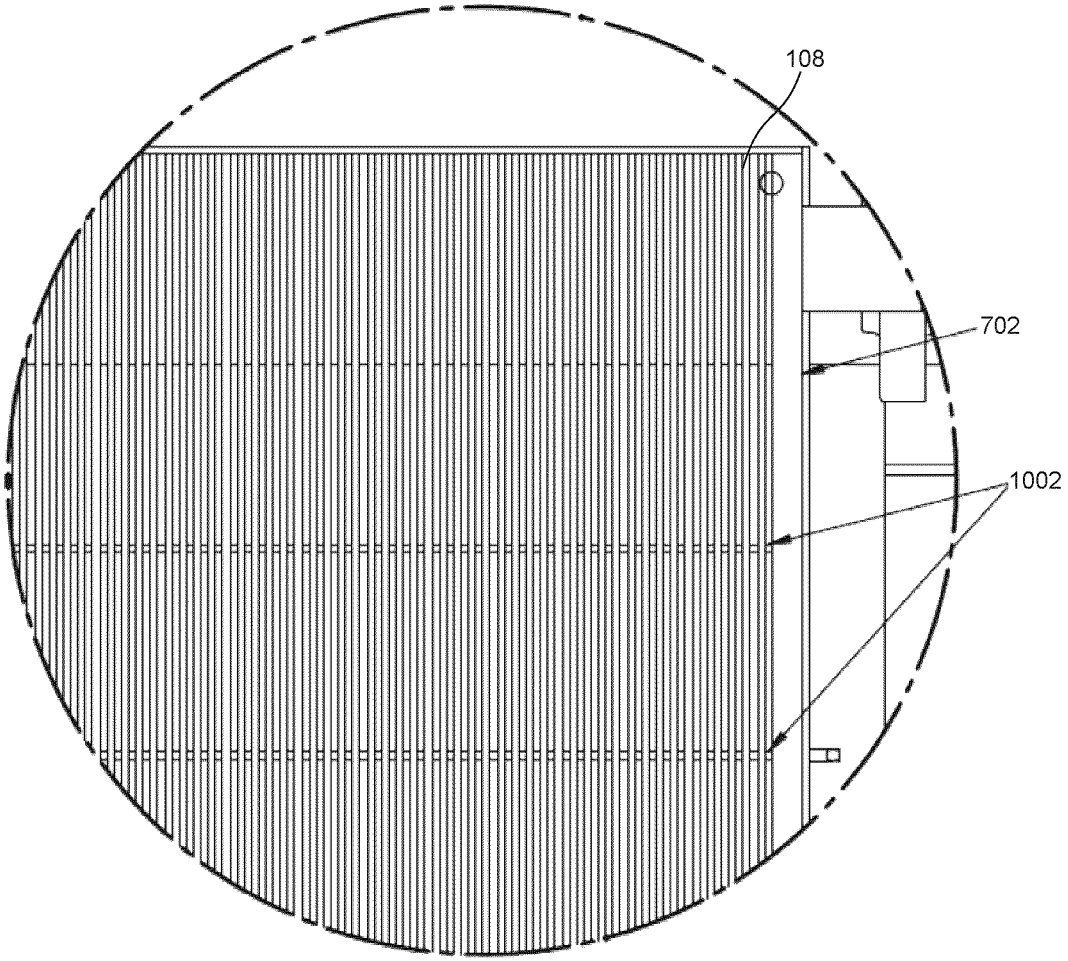
FIG. 10 is a top view of the portion of the heat exchanger of FIG. 9, drawn to a larger scale.

Referring to FIG. 9 and FIG. 10, the heat transfer plate assemblies 108, and end plates 702 are illustrated. Support ribs 1002 extend generally vertically between and abutting adjacent heat transfer plate assemblies 108. The support ribs 1002 are included to stabilize the heat transfer plate assemblies 108 over the length of the heat transfer plate assemblies 108. The support ribs 1002 are included to reduce the deflection of the heat transfer plate assemblies 108 when in use. As shown, the heat transfer plate assemblies 108 are closely spaced and are disposed generally vertically to facilitate the flow of the bulk solids, by the force of gravity, through the spaces between the heat transfer plate assemblies of each bank, and to the outlet 150. Thus, the spaces between the heat transfer plate assemblies 108 in each of the banks 110, 112, 114, 116, 118, 120, 122, 124 provide passageways for the flow of bulk solids through the heat exchanger 100.

Referring again to FIG. 1 through FIG. 3, the discharge hopper 148 in the present example is a generally cone-shaped housing coupled to the bottom bank 124 via the support rails 126 on which the banks 110, 112, 114, 116, 118, 120, 122, 124 are supported. The cone-shaped housing is utilized to establish generally uniform bulk solids mass flow through the heat exchanger 100. The cone-shaped housing provides a "choked flow" of bulk solids exiting the heat exchanger 100, to control the flow rate of the bulk solids through the heat exchanger.

The bottom bank 124 includes an inlet flange 130 attached to a nozzle 708 of an end plate on a first side 132 of the heat exchanger 100, which nozzle 708 is utilized as the fluid inlet to the inlet manifold formed in the heat transfer plate assemblies 108 and spacers 502. A heat exchange fluid source is coupled to the inlet flange 130 when the heat exchanger 100 is in use, for supplying a heat exchange fluid, such as supercritical carbon dioxide, to the heat exchanger 100. The nozzle 708 that is coupled to the end plate on an opposing side, referred to as the second side 134, and is in fluid communication with the outlet manifold formed in the bottom bank 124, is fluidly coupled by a fluid line 136 to the nozzle 708 that is coupled to the inlet manifold formed in the seventh bank 122. Thus, the fluid line 136 couples the fluid outlet manifold of the bottom bank 124 to the fluid inlet manifold of the bank above (the seventh bank 122). A fluid line 138 coupled to the nozzle 708 on the first side 132 of the heat exchanger 100 that is in fluid communication with the fluid outlet manifold of the seventh bank 122 is coupled to the nozzle 708 that is in fluid communication with the inlet manifold of the sixth bank 120. The coupling of fluid outlet manifolds to fluid inlet manifolds of the bank above continues such that the fluid flows in a serpentine fashion through the heat exchanger, to the top bank 110. Thus, the inlet manifold of each of the top, second, third, fourth, fifth, sixth, and seventh banks 110, 112, 114, 116, 118, 120, 122 is coupled to the fluid outlet manifold of the respective bank below. The remaining nozzles 708 that are not utilized for coupling an inlet flange 130, an outlet flange 140, or a fluid line such as the fluid lines 136, 138, are plugged to substantially seal the nozzles and thereby inhibit the flow of the heat exchange fluid out of these unutilized nozzles 708.

The top bank 110 includes an outlet flange 140 attached to a nozzle 708 on an end plate on a first side 132 of the heat exchanger for coupling an outlet line thereto for the flow of the heat exchange fluid, after passing through the heat transfer plate assemblies 108 and out of the heat exchanger 100. In the present example, 8 banks are utilized and the outlet flange 140 is attached to the nozzle 708 on the end plate on the first side 132 of the heat exchanger. Alternatively, an outlet flange may be attached to a nozzle on an end plate on the second side 134 when there are an odd number of banks of heat transfer plate assemblies 108.

Thus, the heat exchange fluid is utilized for indirect heat exchange with the bulk solids as the heat exchange fluid heats the heat transfer plate assemblies 108 for the transfer of heat to the bulk solids as the bulk solids flow through the heat exchanger 100. The heat exchange fluid, however, is separate from and not in contact with the bulk solids that are heated or cooled in the heat exchanger 100. The heat exchange fluid may be introduced to the heat transfer plate assemblies 108 at high temperature and pressure, for example, utilizing supercritical $CO_2$ at a pressure of 200 bar.

The heat transfer plate assemblies 108 of one bank may be offset from the heat transfer plate assemblies of an adjacent bank in any suitable manner. For example, an end plate 702 on one side of a bank may be thicker than the end plate 702 on the opposing side of the bank. The banks may be assembled such that the thicker end plate 702 is one side for a first bank and is on an opposing side for the adjacent bank. Thus, the thicker end plate 702 is located on alternate sides. Utilizing this assembly including banks with the thicker end plates located on alternating sides, the heat transfer plate assemblies 108 may be laterally offset such that the heat transfer plate assemblies 108 of the banks are not all vertically aligned, facilitating heating or cooling of the bulk solids. The resulting dimensions of each bank are such that the banks are similar in size and thus, the outer surfaces of the end plates 702 of one bank are vertically aligned with the outer surfaces of the end plates 702 of a subsequent bank.

End plates 702 of different thicknesses on alternating sides is one example of a suitable assembly for achieving an offset in the heat transfer plate assemblies 108 from bank to bank. Such an offset may be realized utilizing any other suitable assembly such that the heat transfer plate assemblies 108 of one bank 110, 112, 114, 116, 118, 120, 122 are not vertically aligned with the heat transfer plate assemblies 108 of a vertically adjacent bank 110, 112, 114, 116, 118, 120, 122 while maintaining similar outer dimensions of the banks 110, 112, 114, 116, 118, 120, 122.

Each bank 110, 112, 114, 116, 118, 120, 122 of heat transfer plate assemblies 108 is sealed by the end plates 702 and the spacers 502 that, for example, are diffusion bonded together. The banks 110, 112, 114, 116, 118, 120, 122 may be joined together in a stack, and a seal, such as a gasket disposed between vertically adjacent banks 110, 112, 114, 116, 118, 120, 122, for example, to inhibit both dust and air from escaping from the heat exchanger 100. The use of such gaskets may be advantageous when a pressure differential exists between the interior of the heat exchanger 100 and outside the heat exchanger 100 or when a sweep gas is utilized. Alternatively, the banks 110, 112, 114, 116, 118, 120, 122 may be joined together in a stack in the heat exchanger 100 without additional seals such that surfaces of vertically adjacent banks 110, 112, 114, 116, 118, 120, 122 of heat transfer plate assemblies abut each other to inhibit escape of particles out of the heat exchanger 100.

The operation of the heat exchanger 100 will now be described with reference to FIG. 1 through FIG. 3. When bulk solids are fed into the heat exchanger 100, through the inlet 102, the bulk solids flow downwardly as a result of the force of gravity from the inlet 102, into and through spaces between the heat transfer plate assemblies 108. The bulk solids that contact the heat transfer plate assemblies 108 are generally deflected into the spaces between the heat transfer plate assemblies. As the bulk solids flow between the heat transfer plate assemblies 108, the bulk solids are heated or cooled, depending on the application. The heat exchange fluid that flows through the heat transfer plate assemblies indirectly heats the bulk solids.

The bulk solids then flow through out of the discharge hopper 148, which controls the flow of bulk solids from the heat exchanger 100, and out the outlet 150 through which the heated or cooled bulk solids are discharged from the heat exchanger 100.

In the above description, the sheets 402 are etched and diffusion bonded together to form the heat transfer plate assemblies 108. Rather than etching, followed by diffusion bonding, the heat transfer plate assemblies 108 may be 3D printed and then bonded together. Alternatively, the channels 412 may be machined or laser cut into the sheets 402 prior to assembly. The heat transfer plate assemblies may be brazed together rather than diffusion bonded.

As described above, the heat transfer plate assemblies 108, the spacers 502, and the end plates 702 are coupled together by, for example, diffusion bonding. Alternatively, the heat transfer plate assemblies 108, the spacers 502, and the end plates 702 may be coupled together by tie rods that extend through the entire bank to align and maintain the heat transfer plate assemblies 108, the spacers 502, and the end plates 702 in the bank. The entire bank may be sealed or brazed.

In addition, the heat transfer plate assemblies 108 are described as formed from four sheets. Any other suitable number of sheets may be utilized to form the heat transfer plate assemblies 108. For example, two or more sheets may be utilized to form the heat transfer plate assemblies.

In the above-described examples, the through holes of the heat transfer plate assemblies 108 and the spacers in the first bank are all in fluid communication to form continuous conduits, utilized as fluid manifolds. The two continuous fluid manifolds are thus formed through the heat transfer plate assemblies 108 and the spacers 502 in the unitary bank. Alternatively, spacers or sheets within the heat transfer plate assemblies may include only a single hole such that heat exchange fluid travels from the inlet manifold, through more than one heat transfer plate assembly or more than one sheet, before travelling to the outlet manifold.

Advantageously, the heat transfer plate assemblies 108 and the spacers 502 form integral manifolds within the banks. A very high number of relatively thin heat transfer plate assemblies 108 may be employed without requiring a separate manifold coupled to each heat transfer plate assembly 108. High temperature and high pressure heat exchange fluid may be utilized for indirect heat exchange with the bulk solids.

The described embodiments are to be considered in all respects only as illustrative and not restrictive. The scope of the claims should not be limited by the preferred embodiments set forth in the examples, but should be given the broadest interpretation consistent with the description as a whole. All changes that come with meaning and range of equivalency of the claims are to be embraced within their scope.

The invention claimed is:

1. A bulk solids heat exchanger comprising:

an inlet for receiving bulk solids;

a plurality of flat heat transfer plate assemblies, each of the heat transfer plate assemblies comprising:

a flat first sheet having a first pair of holes extending through the first sheet and channels formed in a surface thereof by removal of material from a surface of the first sheet such that the channels do not extend through the entire thickness of the first sheet, for the flow of fluid from a first of the first pair of holes, through the channels, to a second of the first pair of holes, wherein the channels are spaced apart and separate from each other along an entire length thereof from the first of the first pair of holes to the second of the first pair of holes; and a flat second sheet bonded to the first sheet, wherein a majority of the surface of the first sheet is bonded to the second sheet to enclose the channels between the first sheet and the second sheet, the second sheet including a second pair of holes aligned with the first pair of holes of the first sheet to form a first through hole extending from one side of the heat transfer plate assembly to an opposing side of the heat transfer plate assembly, and a second through hole extending from the one side of the heat transfer plate assembly to the opposing side of the heat transfer plate assembly to facilitate flow of the fluid through the first through hole, through the channels, and through the second through hole;

wherein first through holes, including the first through hole of each of the heat transfer plate assemblies are aligned and second through holes, including the second through hole of each of the heat transfer plate assemblies are aligned; and a plurality of flat first spacers and flat second spacers disposed between adjacent heat transfer plate assemblies arranged in parallel, and spacing parallel and flat center portions of the adjacent heat transfer plate assemblies apart to facilitate the flow of the bulk solids from the inlet, along vertical flow paths between the parallel and flat center portions of the adjacent heat transfer plate assemblies, the first spacers and the second spacers each including a linear top edge with vertically extending side edges, wherein the linear top edge of the first spacers and the linear top edge of the second spacers are parallel to and aligned with top edges of the adjacent heat transfer plate assemblies, the first spacers including first spacer holes extending through the first spacers and aligned with the first through holes of the adjacent heat transfer plate assemblies, the second spacers including second spacer holes extending through the second spacers and aligned with the second through holes of the adjacent heat transfer plate assemblies, wherein the first through holes extending through the plurality of heat transfer plate assemblies and the first spacer holes extending through the first spacers are aligned to form a first fluid manifold, and the second through holes extending through the plurality of heat transfer plate assemblies and the second spacer holes extending through the second spacers are aligned to form a second fluid manifold, and the plurality of channels of each of the heat transfer plate assemblies extend from the first fluid manifold to the second fluid manifold.

2. The heat exchanger according to claim 1, wherein each of the first pair of holes is located near a respective one of opposing edges of the first sheet and the first through holes are disposed near a first side edge and the second through holes are disposed near a second side edge of the heat transfer plate assemblies.

3. The heat exchanger according to claim 1, wherein the first sheet is diffusion bonded to the second sheet.

4. The heat exchanger according to claim 1, wherein each of the heat transfer plate assemblies comprise a third sheet having a third pair of holes extending through the third sheet, each of the third pair of holes generally aligned with the first pair of holes of the first sheet, the third sheet having third sheet channels extending along a surface thereof and being bonded to the first sheet to enclose the third sheet channels, for the flow of fluid between the third pair of holes.

5. The heat exchanger according to claim 4, wherein each of the heat transfer plate assemblies comprise a fourth sheet bonded to the third sheet and having a fourth pair of holes extending through the fourth sheet, each of the fourth pair of holes generally aligned with the first pair of holes of the first sheet, the fourth sheet having fourth sheet channels extending along a surface thereof and being bonded to the third sheet to enclose the fourth sheet channels, for the flow of fluid between the fourth pair of holes.

6. The heat exchanger according to claim 1, wherein the heat transfer plate assemblies and the first spacers and the second spacers are diffusion bonded together.

7. The heat exchanger according to claim 1, wherein the channels extending along the surface of the first sheet comprise etched out channels along the first sheet.

8. The heat exchanger according to claim 1, wherein the channels extending along the surface of the first sheet are machined or laser cut into the first sheet.

9. The heat exchanger according to claim 1, wherein the first sheet is 3D printed.

10. The heat exchanger according to claim 1, wherein the plurality of heat transfer plate assemblies are arranged in a first bank having the plurality of the heat transfer plate assemblies and the plurality of the first spacers and second spacers, the heat exchanger comprising a second bank including a second plurality of the heat transfer plate assemblies and a second plurality of the first and second spacers.

11. The heat exchanger according to claim 10, wherein first through holes of the second heat transfer plate assemblies in the second bank are fluidly coupled together by the second plurality of first spacers to form a third fluid manifold, and second through holes of the second plurality of heat transfer plate assemblies in the second bank are fluidly coupled together by the second plurality of second spacers to form a fourth fluid manifold.

12. The heat exchanger according to claim 11, wherein the first bank is disposed above the second bank to facilitate the flow of the bulk solids between spaces between the first plurality of the heat transfer plate assemblies of the first bank, and into spaces between the second plurality of heat transfer plate assemblies of the second bank.

13. The heat exchanger according to claim 12, wherein the first fluid manifold and second fluid manifold of the first bank are in fluid communication with the third fluid manifold and the fourth fluid manifold of the second bank.

14. The heat exchanger according to claim 12, wherein the second fluid manifold is fluidly coupled to one of the third fluid manifold or the fourth fluid manifold.

15. The heat exchanger according to claim 14, comprising a fluid inlet coupled to the first fluid manifold and a fluid outlet coupled to an other of the third fluid manifold or the fourth fluid manifold.

16. The heat exchanger according to claim 1, wherein the plurality of heat transfer plate assemblies are arranged in a plurality of banks, including a top bank, a bottom bank, and intermediate banks disposed generally between the top bank and the bottom bank for the flow of the bulk solids, by the force of gravity, through spaces in each of the banks.

17. A bulk solids heat exchanger comprising:

an inlet for receiving bulk solids;

a plurality of flat heat transfer plate assemblies arranged in banks with the heat transfer plate assemblies of each bank arranged parallel to each other, each of the heat transfer plate assemblies comprising:

a flat first sheet having a plurality of channels extending along a surface thereof, the channels formed by removal of material from a surface of the first sheet such that the channels do not extend through the entire thickness of the first sheet; and a flat second sheet bonded to the first sheet, wherein a majority of the surface of the first sheet is bonded to the second sheet to enclose the channels between the first sheet and the second sheet, the first sheet and the second sheet together having a first through hole extending from one side of the heat transfer plate assembly to an opposing side of the heat transfer plate assembly, near a first side edge of the heat transfer plate assemblies and in fluid communication with first ends of the channels, and a second through hole extending from the one side of the heat transfer plate assembly to the opposing side of the heat transfer plate assembly, near a second side edge of the heat transfer plate assembly and in fluid communication with second ends of the channels to facilitate flow of the fluid through the first through hole, through the channels, and through the second through hole, wherein the channels are spaced apart and separate from each other along an entire length thereof from the first through hole to the second through hole;

a plurality of flat spacers including flat first and flat second spacers disposed between adjacent parallel heat transfer plate assemblies within each bank, to space the adjacent heat transfer plate assemblies and space parallel and flat center portions of the heat transfer plate assemblies apart to facilitate the flow of the bulk solids from the inlet, along vertical flow paths between the parallel and flat center portions of the adjacent heat transfer plate assemblies, the spacers including holes extending therethrough, the first spacers and the second spacers each including a linear top edge with vertically extending side edges, wherein the linear top edge of the first spacers and the linear top edge of the second spacers are parallel to and aligned with top edges of the adjacent heat transfer plate assemblies, wherein the heat transfer plate assemblies and spacers in each bank are coupled together such that the first through holes of the heat transfer plate assemblies and holes of the first spacers form a first fluid manifold, and the second through holes and holes of the second spacers form a second fluid manifold in each bank, and the plurality of channels of each of the heat transfer plate assemblies extend from the first fluid manifold to the second fluid manifold.

18. The heat exchanger according to claim 17, wherein the first sheet is diffusion bonded to the second sheet.

19. The heat exchanger according to claim 17, wherein the heat transfer plate assemblies comprise one or more further sheets bonded with the first sheet and the second sheet, the first through holes and second through holes extending through the one or more further sheets, and including further channels therein extending from the first through holes to the second through holes to facilitate flow of the fluid through the first through holes, through the further channels, and through the second through holes.

20. The heat exchanger according to claim 17, wherein the heat transfer plate assemblies and the first and the second spacers within each bank are diffusion bonded together.

21. The heat exchanger according to claim 17, wherein the channels extending along the surface of the first sheet comprise etched out channels along the first sheet.

22. The heat exchanger according to claim 17, wherein the channels extending along the surface of the first sheet are machined or laser cut into the first sheet.

23. The heat exchanger according to claim 17, wherein the first sheet is 3D printed.

24. The heat exchanger according to claim 17, wherein a first fluid manifold of a top bank is coupled at an end thereof to an inlet for receiving a heat exchange fluid.

25. The heat exchanger according to claim 24, wherein the second fluid manifold of the top bank is fluidly coupled to a first fluid manifold of an adjacent bank.

26. The heat exchanger according to claim 24, wherein one of the first fluid manifold and the second fluid manifold of each bank is fluidly coupled to one of the first fluid manifold and the second fluid manifold of a next, adjacent bank to facilitate the flow of fluid through each of the banks.

27. The heat exchanger according to claim 26, wherein the second fluid manifold of a bottom bank is coupled at an end thereof to a fluid outlet.

28. A bank of heat transfer plate assemblies for use in a bulk solids heat exchanger, the bank of heat transfer plate assemblies comprising:

a plurality of flat heat transfer plate assemblies arranged parallel to each other, each of the heat transfer plate assemblies comprising:

a flat first sheet having a plurality of channels extending along a surface thereof, the channels formed by removal of material from a surface of the first sheet such that the channels do not extend through the entire thickness of the first sheet; and a flat second sheet bonded to the first sheet, wherein a majority of the surface of the first sheet is bonded to the second sheet to enclose the channels between the first sheet and the second sheet, the first sheet and the second sheet together having a first through hole extending from one side of the heat transfer plate assembly to an opposing side of the heat transfer plate assembly, near a first side edge of the heat transfer plate assembly and in fluid communication with first ends of the channels, and a second through hole extending from the one side of the heat transfer plate assembly to the opposing side of the heat transfer plate assembly, near a second side edge of the heat transfer plate assembly and in fluid communication with second ends of the channels to facilitate flow of the fluid through the first through hole, through the channels, and through the second through hole, wherein the channels are spaced apart and separate from each other along an entire length thereof from the first through hole to the second through hole;

a plurality of flat first spacers and flat second spacers disposed between adjacent heat transfer plate assemblies arranged in parallel, and spacing parallel and flat center portions of the adjacent heat transfer plate assemblies apart to facilitate flow of bulk solids along vertical flow paths between the parallel and flat center portions of the adjacent heat transfer plate assemblies, the first spacers and the second spacers including holes extending therethrough, wherein the first spacers and the second spacers each include a linear top edge with vertically extending side edges, the linear top edge of the first spacers and the linear top edge of the second spacers extending parallel to and aligned with top edges of the adjacent heat transfer plate assemblies, and wherein the heat transfer plate assemblies and the first spacers and the second spacers in the bank are coupled together such that the first through hole of each of the heat transfer plate assemblies and holes of the first spacers form a first fluid manifold, and the second through hole of each of the heat transfer plate assemblies and the second spacers form a second fluid manifold, and the plurality of channels of each of the heat transfer plate assemblies extend from the first fluid manifold to the second fluid manifold.

* * * * *